US012808120B2

(12) United States Patent
Jara et al.

(10) Patent No.: US 12,808,120 B2
(45) Date of Patent: Nov. 24, 2026

(54) SYSTEMS AND TECHNIQUES FOR CONTROLLING ODOR EMISSIONS FROM PULP MILLS

(71) Applicant: Ecolab USA Inc., Saint Paul, MN (US)

(72) Inventors: Marcial Jara, Concepción (CL); Fabiana Takaezu, João Aranha Paulínia (BR); Felipe Marnich, Concepción (CL); Edgardo Vasquez, Concepción (CL)

(73) Assignee: Ecolab USA Inc., Saint Paul, MN (US)

( * ) Notice: Subject to any disclaimer, the term of this patent is extended or adjusted under 35 U.S.C. 154(b) by 80 days.

(21) Appl. No.: 18/666,774

(22) Filed: May 16, 2024

(65) Prior Publication Data

US 2024/0384467 A1 Nov. 21, 2024

Related U.S. Application Data

(60) Provisional application No. 63/503,397, filed on May 19, 2023.

(51) Int. Cl.

| | |
|---|---|
| ***D21C 11/08*** | (2006.01) |
| ***D21C 11/00*** | (2006.01) |
| ***D21C 11/12*** | (2006.01) |

(52) U.S. Cl.
CPC ..... *D21C 11/08* (2013.01); *D21C 11/0057* (2013.01); *D21C 11/127* (2013.01)

(58) Field of Classification Search
CPC .... D21C 11/08; D21C 11/0057; D21C 11/127
See application file for complete search history.

(56) References Cited

U.S. PATENT DOCUMENTS 2,830,869 A * 4/1958 Mck Limerick ..... D21C 11/08 422/5
3,404,063 A * 10/1968 Harding ..... D21C 11/0042 159/4.04

(Continued)

FOREIGN PATENT DOCUMENTS

WO WO-2019188408 A1 * 10/2019 ..... A61L 9/032
WO WO-2020230233 A1 * 11/2020 ..... F24F 11/79

OTHER PUBLICATIONS

Smook, Handbook for Pulp and Paper Technologists, 1992, Angus Wilde Publications, 2nd edition, chapters 24 and 27. (Year: 1992).*

(Continued)

*Primary Examiner* — Anthony Calandra
(74) *Attorney, Agent, or Firm* — Fredrikson & Byron, P.A.

(57) ABSTRACT

Systems and techniques can be used to control malodorous emissions from pulp mills, such as Kraft pulp mills discharging sulfur and/or nitrogen-based compounds displeasing to persons living or working in areas neighboring the pulp mill. In some examples, one or more sensors are used to measure air characteristics around the pulp mill. Example sensors include wind sensors and gas sensors. The sensors can provide data indicating whether malodorous emissions will likely blow toward a population concentration area or away from a population concentration area and/or the indicating the concentration of a malodorous compound in the measured air. Control actions can be taken based on the measured sensor data, such as controlling delivery of an odor control agent to reduce or eliminate the malodorous emissions.

9 Claims, 4 Drawing Sheets

(56) References Cited

U.S. PATENT DOCUMENTS

| | | | | |
|---|---|---|---|---|
| 3,549,314 | A | 12/1970 | Shah | |
| 3,701,824 | A | 10/1972 | Prahacs et al. | |
| 6,030,494 | A * | 2/2000 | Hupa | F23J 15/00 423/242.1 |
| 9,080,286 | B2 | 7/2015 | Mattelmki et al. | |
| 11,306,435 | B2 | 4/2022 | Rowlands et al. | |
| 2006/0254733 | A1 * | 11/2006 | Dunn | D21C 11/0057 162/16 |
| 2011/0009986 | A1 * | 1/2011 | Page | B01D 53/38 702/3 |

OTHER PUBLICATIONS

Cabrera "Pulp Mill Wastewater: Characteristics and Treatment" Biological Wastewater Treatment and Resource Recovery, Published online Mar. 29, 2017, p. 22.

ECOSORB "Pulp & Paper Manufacturing Odor Control" Retrieved from https://ecosorbindustrial.com/industries/pulp-paper/, Downloaded May 16, 2024, p. 7.

International Searching Authority "International Search Report and Written Opinion" From Application No. PCT/US2024/029805, Mailed Jul. 16, 2024, p. 11.

* cited by examiner

SYSTEMS AND TECHNIQUES FOR CONTROLLING ODOR EMISSIONS FROM PULP MILLS

RELATED APPLICATION

This application claims the benefit of U.S. Provisional Application No. 63/503,397, filed on May 19, 2023, the entire contents of which are incorporated herein by reference.

TECHNICAL FIELD

This disclosure relates to control of malodorous discharges and, more particularly, to control of malodorous discharges emitted from pulp mills.

BACKGROUND

A pulp mill is a manufacturing facility that converts wood chips or other plant fiber sources into cellulose-rich pulp fibers. Pulp can be manufactured using mechanical, semi-chemical, or fully chemical methods (kraft and sulfite processes), with finished product being either bleached or non-bleached. In the pulping process of a kraft pulp mill, which is also referred to as a sulfate pulp mill, wood chips are converted to cellulose rich pulp fibers by selectively dissolving the wood extractives (resins and fatty acids), hemicelluloses and the lignin fractions of the woody matrix. Wood chips are treated in white liquor containing sodium hydroxide and sodium sulfide, hydrolyzing lignin molecules binding the cellulose fibers together.

The pulping process, particularly the kraft pulping process, can produce malodorous discharges. For example, various organic sulfur compounds that may be formed during the pulping processing include methyl mercaptan, dimethylsulfide and dimethyldisulfide. These compounds alone or together with hydrogen sulfide can cause an unpleasant smell in exhaust gases of the pulp mills. The gases may be formed in several stages of a pulping process, such as at the digester plant and the waste liquor evaporation. Since many pulp mills are located near populated areas, operators of pulp mills may desire to control malodorous discharges to minimize disruptive smells interfering with the neighboring population.

SUMMARY

In general, this disclosure is directed systems and techniques for controlling malodorous discharges, particularly malodorous discharges generated and/or emitted from a pulp mill during the process of pulping fiber material. In some examples, the systems and techniques are utilized at a Kraft pulp mill discharging sulfur and/or nitrogen-based compounds displeasing to persons living or working in areas neighboring the pulp mill. In some examples, one or more sensors are deployed and used to measure air characteristics around the pulp mill. Example sensors include wind sensors and gas sensors. The sensors may provide data indicating whether malodorous emissions will likely blow toward a population concentration area or away from a population concentration area. The sensors may additionally or alternatively provide data indicating the concentration of a malodorous compound in the measured air. Control actions can be taken based on the measured sensor data, such as controlling delivery of an odor control agent to reduce or eliminate the malodorous emissions.

For example, the pulp mill may include one or more delivery devices operable to deliver an odor control agent to the air at a location malodorous gas is emitting at the pulp plant. For example, a delivery device may operate by spraying, misting, vaporizing, and/or atomizing a liquid form of the odor control agent into the air at a source location of a malodorous gas at the pulp plant. The odor control agent may mask and/or react with malodorous compounds in the discharging gas. Operation of the one or more delivery devices can be controlled based on measured information received from the sensor(s). For example, delivery of the odor control agent may be started or stopped depending on whether the wind is blowing in a direction toward or away from a populated area neighboring the pulp mill. As another example, delivery of the odor control agent may be started or stopped (or a delivery rate increased or decreased) depending on whether a measured concentration of one or more compounds known to contribute to a malodorous smell is above or below an acceptable threshold.

In one example, a method for controlling odor emissions from a pulp mill is described. The method includes receiving data from a sensor indicative of a characteristic of air associated with a pulp mill to provide a measured air characteristic and comparing the measured air characteristic to a target air characteristic. The method also includes controlling delivery of an odor control agent based on comparison of the measured air characteristic to the target air characteristic.

In another example, a pulp mill odor control system is described that includes a sensor, a delivery device, and a controller. According to the example, the sensor is positioned to measure a characteristic of air associated with a pulp mill to provide a measured air characteristic. The delivery device is configured to be fluidly coupled to a source of an odor control agent and to deliver the odor control agent to a location where a malodorous gas is emitted at the pulp mill. The controller is communicatively coupled to the sensor and the delivery device. The example specifies that the controller is configured to receive data from the sensor indicative of the measured air characteristic, compare the measured air characteristic to a target air characteristic, and control the delivery device to deliver the odor control agent based on comparison of the measured air characteristic to the target air characteristic.

The details of one or more examples are set forth in the accompanying drawings and the description below. Other features, objects, and advantages will be apparent from the description and drawings, and from the claims.

DETAILED DESCRIPTION

Figure 1:
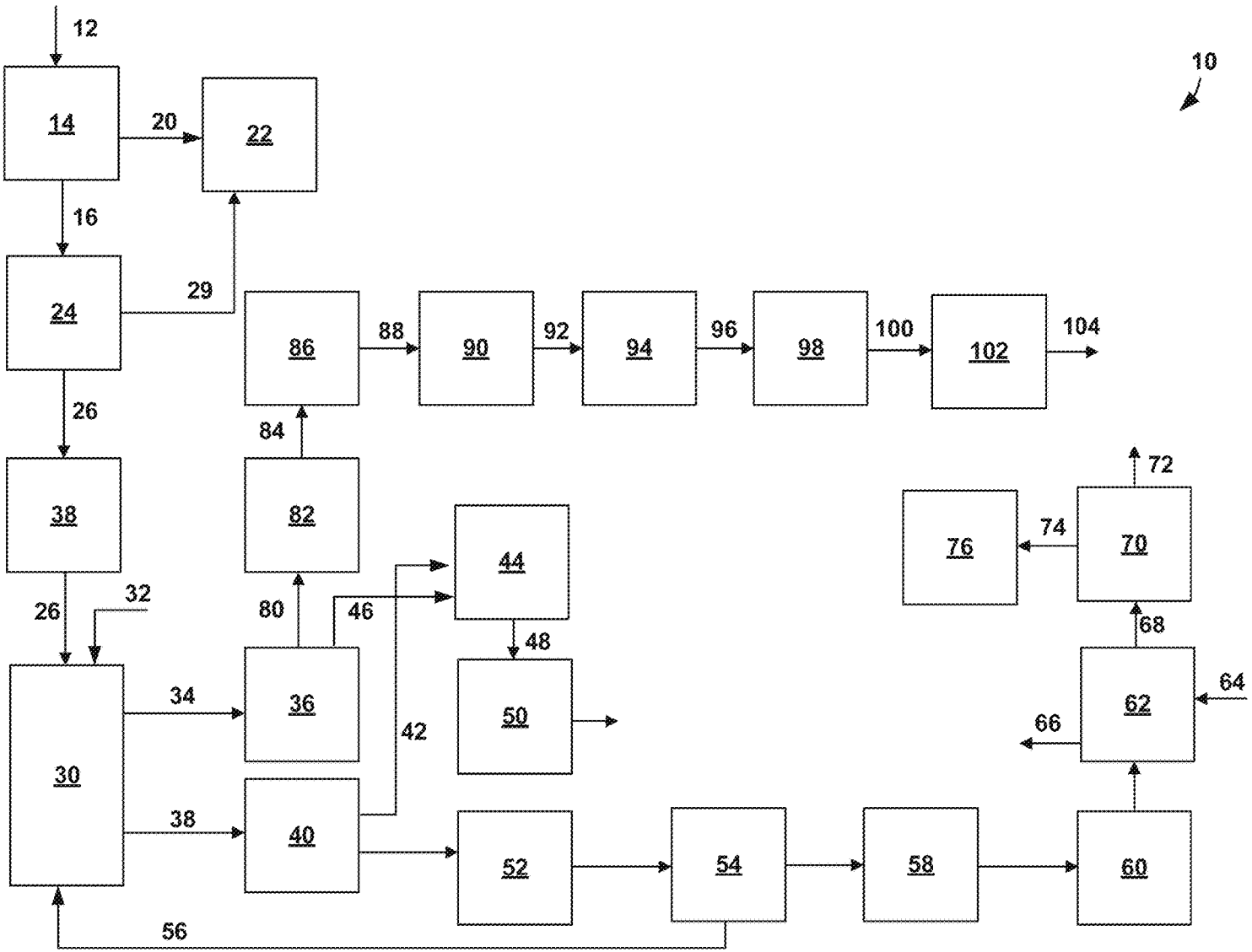
FIG. 1 is a block diagram illustrating an example Kraft pulp mill that can utilize odor control agent delivery systems and techniques according to the disclosure.

This disclosure is generally directed to systems and techniques for controlling malodorous discharges, particularly from pulp mills such as kraft pulp mills. In some examples, an odor control system is provided that includes one or more delivery devices operable to deliver an odor control agent to the air adjacent where a malodorous gas is discharging into the air. The odor control agent may mask and/or react with malodorous compounds in the discharging gas to reduce or eliminate the perception of malodor to the human olfactory system. The odor control agent may be delivered in an aerosolized form (e.g., as a spray, mist) and/or gaseous form so as to intermix within the malodorous gas.

In some examples, one or more sensors are positioned to measure characteristics of the air into which the malodorous gas discharges. For example, the one or more sensors may include a wind sensor configured to measure a speed and/or direction of the air. Additionally or alternatively, the one or more sensors may include a gas sensor configured to detect the presence and/or concentration of one or more malodorous compounds that may be present in a gas discharged from the pulp mill. Various control actions can be taken based on measurement data obtained from the one or more sensors.

For example, data from one or more wind sensors may indicate a speed and/or direction of the wind in the area where the malodorous gas is discharging from the pulp mill. The one or more wind sensors can be positioned in close proximity to individual discharge outlets of the malodorous gas or can be positioned to measure one or more wind conditions more generally at the pulp mill site. In either case, delivery of an odor control agent can be controlled based on data from the one or more wind sensors. For example, if data from the one or more wind sensors indicates that the wind is traveling in a first direction (e.g., toward a population center) and/or at a first speed, delivery of the odor control agent may be started and/or the amount of odor control agent delivered may be increased. By contrast, if data from the one or more wind sensors indicates that the wind is traveling in a second direction (e.g., away from a population center) and/or a second speed (e.g., a lighter wind than the first speed), delivery of the odor control agent may be stopped and/or the amount of odor control agent delivered may be reduced.

Additionally or alternatively, data from one or more gas sensors may indicate the presence and/or concentration of one or more malodorous compounds that may be present in a gas discharged from the pulp mill. The one or more gas sensors can be positioned in close proximity to individual discharge outlets of the malodorous gas or can be positioned at other desired locations, e.g., such as between the gas discharge location (the entire pulp mill facility) and a population center. In some examples, the one or more gas sensors can be selected and configured to measure very low concentrations of a malodorous compound, such as concentrations in the parts per billion (ppb) (e.g., 100 ppb or less, such as 50 ppb or less, or 10 ppb or less). Such low concentrations of gas may be detectable by the human olfactory system, providing a measurement information corresponding to that detectable workers at the pulp mill and the general population around the pulp mill. Example malodorous compounds that may be detected include sulfur-based compounds (e.g., mercaptans, sulfides (e.g., dimethylsulfide dimethyldisulfide, hydrogen sulfide), nitrogen-based compounds (e.g., ammonia), and/or other target compounds.

Delivery of an odor control agent can be controlled based on data from the one or more gas sensors. For example, if data from the one or more gas sensors indicates that a concentration of one or more malodorous compounds is above a target threshold, delivery of the odor control agent may be started and/or the amount of odor control agent delivered may be increased. By contrast, if data from the one or more gas sensors indicates that the concentration of one or more malodorous compounds is below a target threshold, delivery of the odor control agent may be stopped and/or the amount of odor control agent delivered may be reduced.

Sensorized systems and techniques for controlling the delivery of an odor control agent can be beneficial for a variety of reasons. By monitoring one or more characteristics of the air into which malodorous gas discharges and/or one or more characteristics of the malodorous gas itself, better deliver control of an odor control agent can be achieved to counteract the malodor. This can provide better community stewardship and environmental experiences for individuals living and working in close proximity to the pulp mill site. This and also allow more efficient and cost effective utilization of the odor control agent.

Figure 2:
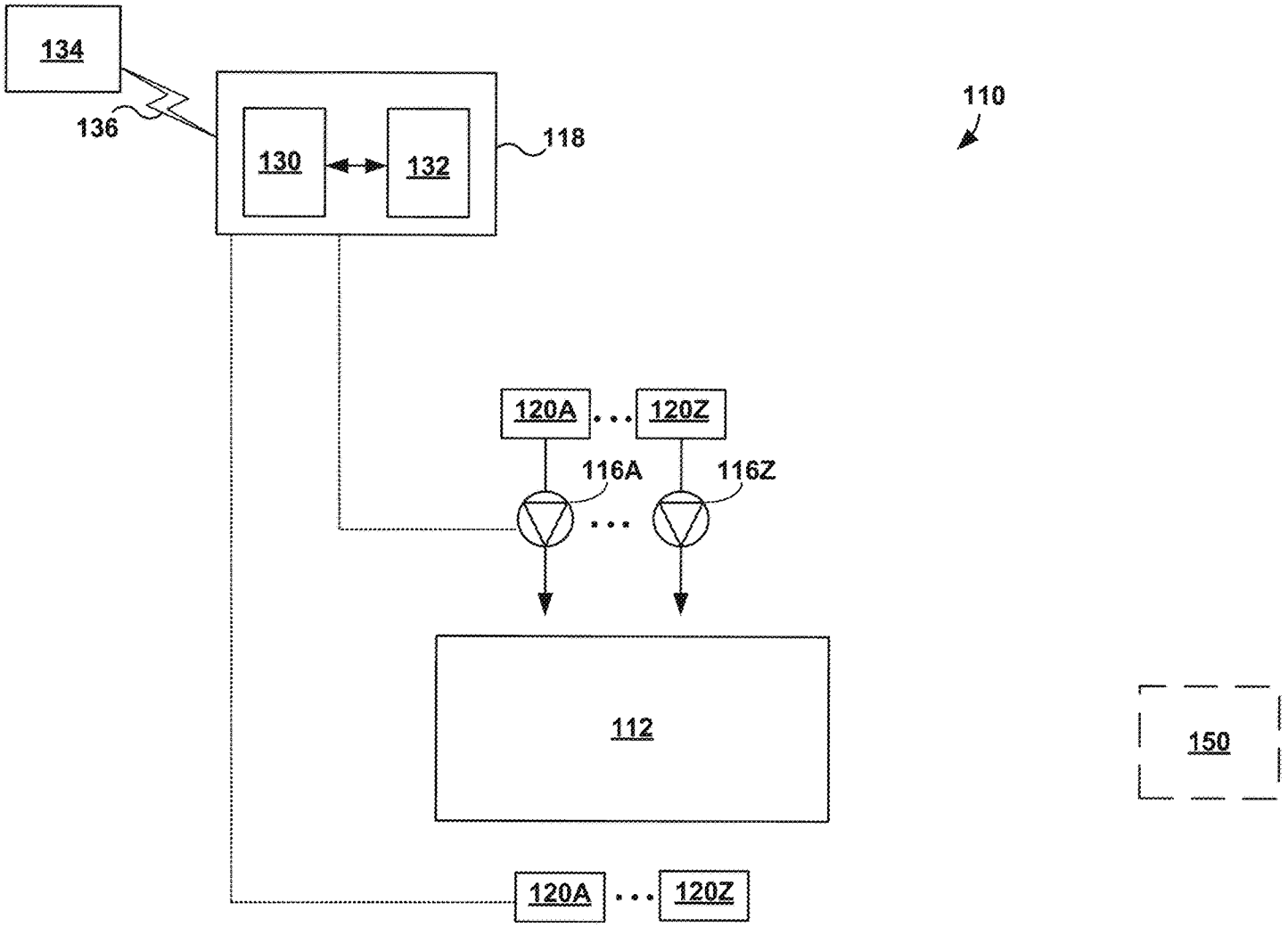
FIG. 2 is a conceptual diagram of an example pulp mill odor control system that can be implemented at the pulp mill of FIG. 1 to help control malodorous emissions from the pulp mill.
Figure 3:
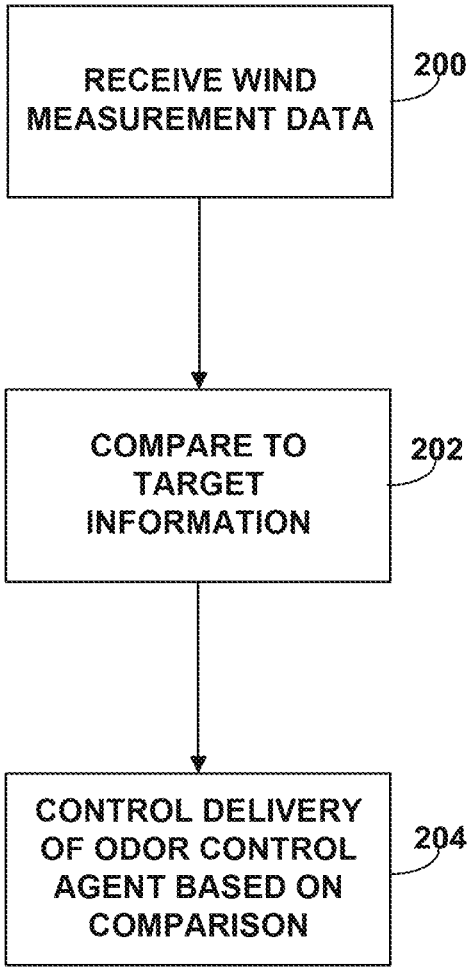
FIG. 3 is a flow diagram illustrating an example technique that can be implemented in the system of FIG. 2 using a wind sensor.
Figure 4:
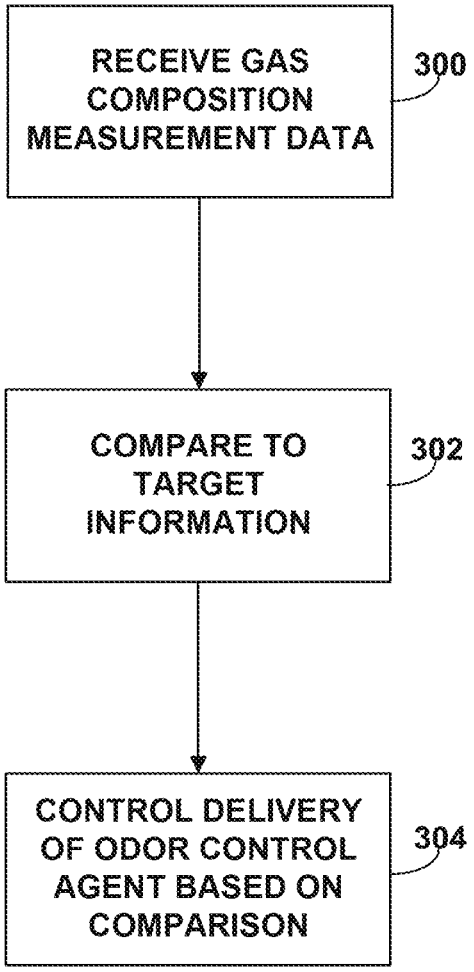
FIG. 4 is a flow diagram illustrating an example technique that can be implemented in the system of FIG. 2 using a gas sensor.

Example systems and techniques for controlling deliver of an odor control agent based on sensor feedback are described in greater detail with respect to FIGS. 2-4. However, an example pulp mill that may utilize odor control systems and techniques will be first described with respect to FIG. 1.

In general, cellulose pulp can be obtained from wood feedstock through the pulping process and is the main raw material used in the production of different types of paper, paperboard, and absorbent materials, such as tissues, toweling, diaper, and sanitary products. Cellulosic pulp can be generated through pulp mills operating mechanical and/or chemical pulping processes. One method of mechanical pulping is the groundwood process in which round logs are forced against a rotating pulp stone, under specified conditions of pressure and temperature. Atmospheric grinding, pressure grinding, or thermo-grinding can be performed according to an applied temperature and pressure. Under all conditions, the temperature obtained from the heat applied or from the logs rubbing on the stone soften and break down the fiber structure and cracks the fibers from the wood matrix.

Another common method of mechanical pulping is referred to as refiner mechanical pulping (RMP). In this technique, wood chips are pulled between two rotating disks. Thermomechanical pulping operates similar to RMP, but under higher temperature and pressure. The high temperature and pressure levels soften the lignin more than frictional heat, making fiber separation easier.

Chemical pulping techniques include sulfite pulping processes and Kraft pulping processes (which is also referred to as a sulfate pulping process). In sulfite pulping, wood fiber is processed and cooked in a process that uses aqueous sulfur dioxide ($SO_2$) and a base: calcium, sodium, magnesium or ammonium. In Kraft pulping, white liquor, containing active chemicals sodium hydroxide and sodium sulfide is used to cook wood chips at a high temperature (150-170° C.) and pressure. Typically, approximately half of the wood composition degrades and dissolves during cooking. The spent cooking liquor (black liquor) contains reaction products of lignin and hemicelluloses and may be concentrated and burned in a recovery boiler that recovers the cooking chemicals and generates energy. The smelt is dissolved into water to form green liquor (sodium carbonate and sodium sulfide), which can then be reacted with lime to convert the sodium carbonate into sodium hydroxide thereby regenerating the white liquor. After cooking and washing, a brown pulp (brown stock pulp) is obtained. White pulp can be obtained by bleaching the brown pulp to remove excess lignin and chromophores.

Systems and techniques for controlling deliver of an odor control agent can be implemented at pulp mills operating any type of mechanical and/or chemical pulping process (e.g., waste water treatment associated with the processes, gas discharges from sulfite pulp mills). In practice, Kraft pulping process may present a greater concern for malodorous discharges than other types of pulping processes because of the chemistry involved in the Kraft process. The Kraft pulping process can produce gaseous sulfur compounds called "total reduced sulfur" or TRS gases. The odor associated with TRS gases is often described as "rotten cabbage" or "rotten eggs."

FIG. 1 is a block diagram illustrating an example Kraft pulp mill 10 (also referred to as "mill 10" and "system 10") that can utilize odor control agent delivery systems and techniques according to the disclosure. Pulp mill 10 can include various unit operations, such as a wood handling unit operation, a digester unit operation, a bleach plant unit operation, a chemical recovery unit operation, and a waste water treatment unit operation.

The digester unit operation is responsible for the chemical digestion of lignocellulosic materials with caustic white liquor under pressure and temperature to produce wood pulp of cellulose fibers. The combined liquids following digestion, known as black liquor, contain lignin fragments, carbohydrates from the breakdown of cellulose and hemicelluloses, extractives including hydrolyzed resin and fatty acids, sodium sulphate, and other inorganic materials.

Pulp generated in the digester unit operation can be conveyed to a bleach plant unit operation for chemical processing with chlorine dioxide, sodium hydroxide, and/or peroxide to remove the residual lignin and chromophores to increase its brightness. Effluent from the bleach plant unit operation may be conveyed to a waste water treatment unit operation. Black liquor from the digester unit operation can be conveyed to a chemical recovery unit operation in which condensates are recovered from the black liquor, black liquor is burned to generate high pressure steam for use elsewhere in the mill, and white liquor is regenerated for reintroduction into the digester for further pulping.

In the example of FIG. 1, a lignocellulosic material can is introduced into system 10 as, for example, wood 12. Wood 12 can be conveyed to a de-barker 14 where it is debarked. De-barked wood 16 can then be conveyed to a wood chipper 24, while bark 20 from the chipping process may be conveyed to a boiler 22. Wood chips 26 produced by wood chipper 24 may be conveyed to a chip bin 28, while chipping fines 29 may be conveyed to boiler 22. Boiler 22 can generate high pressure steam for use within the pulp mill and/or steam that is fed to turbines to generate electricity for use in the mill. For example, steam may be supplied to the digesters, the evaporators and concentrators, pulp dryers and paper machine dryer operating in the pulp mill.

From chip bin 28, wood chips 26 may be conveyed to a kraft digester 30 where the wood chips are mixed with caustic white liquor 32 and cooked at high temperature and pressure to produce delignified pulp and black liquors. White liquor can be an alkaline aqueous solution that includes sodium hydroxide and sodium sulfide, and other sodium salts, such as sodium sulfate ($Na_2SO_4$) and sodium carbonate ($Na_2CO_3$) and small amounts of sulfites and chlorides. White liquor may arise from treatment of green liquor with lime ($CaO/Ca(OH)_2$). The green liquor may optionally be clarified to remove insoluble materials (e.g. calcium compounds, unburned carbon, metals) prior to treatment with the lime. The precise chemical makeup of white liquor may depend on factors such as the specific reaction conditions used to prepare it from green liquor, and the nature of the green liquor from which it is derived. By way of non-limiting example, white liquor may comprise between about 48 wt % and 58 wt % sodium hydroxide (NaOH), between about 15 wt % and 25 wt % sodium sulfide ($Na_2S$), between about 10 wt % and about 20 wt % sodium carbonate (Na2CO3), between about 1 wt % and about 5 wt % sodium sulfite ($Na_2SO_3$), between about 2 wt % and about 7 wt % sodium sulfate ($Na_2SO_4$), and between about 1.5 wt % and about 4 wt % sodium thiosulfate.

Hot, pressurized black liquor 34 can be removed from digester 30 and conveyed to a flash tank 36. Cooked pulp 38 can be conveyed to a blow tank 40 where the pressure is reduced to atmospheric pressure to release steam and volatiles. Volatiles 42 from the blow tank 40 can be condensed and conveyed to a turpentine decanter 44. Black liquor 34 can be flashed to atmospheric pressure in flash tank 36, releasing steam, entrained Total-Reduced Sulfur compounds (TRS), methanol, and turpentine. The volatiles 46 can pass through a condenser and be conveyed to turpentine decanter 44, where turpentine may be recovered as overflow and foul condensates 48 may be recovered as underflow. Foul condensates 48 may be conveyed to a stripper 50 to remove TRS. Vent gases produced from the digester 30, flash tank 36, and/or stripper 50, among other locations in system 10, may contain malodorous compounds.

The cooked pulp recovered from the digester, also referred to as brown stock pulp, can be conveyed from blow tank 40 to a knotter 52 where undigested knots are screened from the brown stock pulp and conveyed to boiler 22. The resulting de-knotted brown stock pulp can be conveyed from knotter 52 to brown stock washers 54 where residual black liquor is separated from cellulose fiber by washing with water. In practice, a pulp mill may have several brown stock washers arranged in series, with wash water moving countercurrent to the direction that the pulp is moving through the washers. A portion of the brown stock washer filtrate 54, which includes a mixture of wash water and black liquors removed from the brown stock pulp, may typically be conveyed from brown stock washers 54 to digester 30 for mixing with the cooking liquors, washing the pulp, and removing black liquor at high temperature and pressure.

From brown stock washers 54, brown stock pulp can be conveyed to a screen room 58 where shives, fines, dirt and other debris may be removed and conveyed to boiler 22. Screened brown stock pulp can then be then conveyed to oxygen delignification 60 to remove residual lignin. The oxygen-delignified pulp may then be conveyed to post-oxygen washers 62 for further washing. In practice, multiple post-oxygen washers may be arranged in series with wash water moving countercurrent to the direction that the pulp is moving through the washers. Wash water 64 is typically introduced to the digester system at post-oxygen washers 62. Brown stock wash water 66 may be conveyed from post-oxygen washers 62 to brown stock washers 54. A portion of brown stock wash water 66 may also be conveyed to screen room 58 before being re-directed to brown stock washers 54.

From the screen room 58 or the post-oxygen washers 62, screened brown stock or oxygen-delignified pulp 68 may be conveyed to a bleach plant 70 for further delignification and brightening. Bleaching agents including chlorine dioxide, ozone, peroxide and/or further caustic may be provided to bleach plant 70 for bleaching of the brown or oxygen-delignified pulp 68. For example, chlorine dioxide may be produced by a sodium chlorate plant and conveyed to bleaching plant 70. Pulp can exit the bleach plant as bleached market pulp 72. Bleach plant effluent 74, which includes caustics, organic molecules, and chloride, may be sent to a waste water treatment plant 76 of the mill. Waste water treatment plant 76 can receive all other waste water streams within the mill for processing prior to reuse or discharge.

Weak black liquor 80 recovered from flash tank 36 may be conveyed to a weak black liquor storage tank and/or further processing. For example, weak black liquor 80 may be conveyed to conveyed to multiple effect evaporators 82 where it is concentrated. During this concentration process, the partially concentrated black liquor (e.g., at a solids concentration between 25 and 40%) may be directed to an evaporator skim tank where tall oil soap rises to the surface of the liquor where it is skimmed and then processed to tall oil. From evaporators 82, a strong black liquor 84 may be conveyed to a concentrator 86 where the black liquor is further concentrated to a heavy black liquor 88 that is conveyed to a recovery boiler 90.

Multiple effect evaporators 82 may also produce several condensate streams including a clean condensate, a foul condensate, and/or a combined condensate. Clean condensates may typically be conveyed to polishers or to post-oxygen washers 62, or for heat exchanging with other streams. Combined condensates may be conveyed to post-oxygen washers 62. Foul condensates may be conveyed to a stripper before re-use and/or discharge (e.g., through waste water treatment plant 76).

The portion of heavy black liquor 88 that is conveyed to recovery boiler 90 may be burned to recover inorganic chemicals for reuse in the pulping process. The higher concentration of solids in the heavy black liquor 88 increases the energy and chemical efficiency of the recovery cycle. Smelt 92 produced in recovery boiler 90 can be conveyed to a dissolving tank 94 where it is dissolved in a process water known as weak wash to produce green liquor 96. Recovery boiler 90 can also generates high pressure steam. Green liquor 96 can be conveyed from dissolving tank 94 to a green liquor clarifier 98. Clarified green liquor 100 is generally conveyed to the causticizers 102 where it is mixed with calcium oxide (lime) to produce white liquor 104. White liquor 104 can then be conveyed to a white liquor clarifier to produce a clarified white liquor that is conveyed to digester 30 for use in pulping.

Vent gas streams may be discharged at various locations throughout pulp mill 10, including water treatment plant 75. Further, open solid and liquid receiving reservoirs may receive solid or liquid material at various locations throughout pulp mill 10. Malodorous gases can emit for these or other locations within pulp mill 10 that may desirably be treated with one or more odor control agents.

FIG. 2 is a conceptual diagram of an example pulp mill odor control system 110 that can be implemented at pulp mill 10 (FIG. 1) to help control malodorous emissions from the pulp mill. System 110 conceptually illustrates an example location 112 where a malodorous gas may be emitted at the pulp mill. In practice, the pulp mill may include multiple discrete locations 112 where malodorous gases can be emitted and the treatment systems and techniques described herein implemented. However, for simplicity of discussion, a single emission location 112 is illustrated in the example of FIG. 2.

In the illustrated example of FIG. 2, system 110 includes one or more sensors 114 for measuring one or more characteristics used to control the delivery of treatment chemistry for controlling a malodorous emission emitted from location 112. System 110 also includes one or more delivery devices 116 operable to deliver one or more odor control agents. A controller 118 manages the overall operation of system 110. In operation, sensor 114 can measure, and controller 118 can receive, data indicative of one or more measured characteristics associated with the location 112 where malodorous gas may be emitted. The one or more measured characteristics may be one or more air characteristics indicative of the direction of air movement, the speed of air movement, and/or the composition of one or more compounds in the air (e.g., one or more compounds causing a malodorous smell). Operating under the control of controller 118, the one or more delivery devices 116 can deliver one or more odor control agents based on the measured characteristic(s) to reduce or eliminate a malodorous smell as determined to be necessary or appropriate.

In general, location 112 in system 110 of FIG. 2 may be any location at a pulp plant from which a malodorous gas may be emitted during operation of the pulp plant. Location 112 may be an outlet of a vent pipe or other gas discharge port through which gas continuously or periodically discharges during operation of the pulp plant. Additionally or alternatively, location 112 may be a solid waste reservoir (e.g., sludge reservoir or bunker) that receives solid waste product during operation of the pulp mill. Such solid waste may emit a malodorous gas as liquid present on the solid waste vaporizes into the surrounding air. Yet further additionally or alternatively, location 112 may be a liquid reservoir that receives liquid waste or product during operation of the pulp mill. For example, location 112 may be a pond or vessel (e.g., tank) that is open to the ambient air and that receives waste water as part of a waste water treatment plant associated with the pulp mill. A malodorous gas can emit from the location as liquid vaporizes into the surrounding air.

Examples of location 112 within pulp mill 10 (FIG. 1) where a malodorous gas may be emitted include, but are not limited to, the digester, the lime kiln, the causticizer, the recovery boiler, and/or the sludge pit. Additionally or alternatively, examples of location 112 within pulp mill 10 include one or more locations in the waste water treatment plant that processes waste water for the pulp plant and/or water treatment system for the plant. For example, the water treatment system for pulp mill 10 may include a clarifier, a neutralizer in which effluent is pH neutralized, a cooling tower, and the like. Each such location may emit malodorous gas that is desirably treated. It should be appreciated that reference to a malodorous gas includes mixed phase streams (e.g., combined liquid and gas steams), e.g., in which one or more malodorous compounds may be in the gas phase and/or liquid phase but entrained within a gas stream.

System 110 in FIG. 2 can include one or more sensors 114A-114Z (collectively "sensor 114"), which may measure one or more characteristics indicative of how malodorous a gas emission may be to a neighboring human population to the pulp mill site. For example, sensor 114 can measure a characteristic of the air associated with the pulp mill to provide measurement information for controlling delivery of one or more odor control agents. Example sensors that may be used as sensor 114 include a wind sensor operable to measure a speed and/or direction of the wind and/or a gas sensor configured to detect a presence and/or measure a concentration of one or more compounds associated with a malodorous smell.

The one or more sensors 114 may be positioned in close proximity to location 112 where malodorous gas may be emitted or may be positioned at a distance from location 112 (e.g., elsewhere on the pulp mill site). For instance, in some examples, one or more sensors 114 may be positioned at a location 250 meters (m) or less from location 112 where malodorous gas may be emitted, such as 100 m or less, 50 m or less, 25 m or less, 10 m or less, or 5 m or less. When sensor 114 is implemented as a gas sensor, the gas sensor may be at or immediately adjacent a gaseous discharge at location 112. When sensor 114 is implemented as a wind sensor, the wind sensor may at or immediately adjacent a gaseous discharge at location 112 or may be located elsewhere on or near the pulp mill site to provide information about wind conditions in the region of the pulp mill.

System 110 may include a variety of additional and/or different sensors to measure different parameters. For example, system 110 may include one or temperature sensors to measure a temperature of the air and/or gaseous discharge at location 112. As another example system 110 may include one or more flow sensors to measure a flow rate of a gaseous discharge at location 112 (e.g., through the outlet of a vent pipe).

As briefly discussed above, system 110 can include one or more delivery devices 116A-116Z (collectively "delivery device 116") operable to deliver one or more odor control agents 120A-120Z (collectively "odor control agent 120") to help reduce or substantially eliminate the malodor emanating from location 112. Each feature described as a delivery device 116 can be implemented in a variety of different ways. In some examples, each delivery device 116 can introduce an odor control agent 120 to the air adjacent to location 112 where malodorous gas may be emitted. Delivery device 116 may be a fluid pressurization device (e.g., pump), a blower (e.g., fan), a flow control device (e.g., valve), and/or other feature operable under the control of controller 118 to control the delivery of odor control agent 120 (e.g., on/off delivery, variable rate delivery).

While odor control agent 120 may be provided in gaseous form, more commonly, the odor control agent may be provided in liquid form. For example, reservoirs (e.g., drum, tote, tank) containing odor control agent 120 may be fluidly connected to a pump 122 associated with each delivery device 116 and the pump controlled under the control of controller 118 to controllably deliver the odor control agent. In various examples, each delivery device 116 may include a spray nozzle, mister, vaporizer, and/or atomizer either directly or indirectly coupled via fluid conduit(s). In either case, each delivery device 116 may introduce odor control agent 120 to the air, e.g., by introducing the odor control agent to the air adjacent to location 112 where malodorous gas is emitted and/or directly to the malodorous gas emission stream (e.g., prior to being discharged from a vent or other conduit).

Each location 112 where malodorous gas may be emitted may be provided with a single delivery device 116 or may be provided with multiple delivery devices (e.g., two, three, four, or more). For example, a plurality of discharge nozzles each fluidly connected to a single pump may be arrayed about a perimeter of location 112, e.g., providing perimeter coverage of the location. When using multiple delivery devices 116, each deliver device may be fluidly connected to the same odor control agent 120 (e.g., the same reservoir or different reservoirs containing the same chemistry), or different delivery devices may be fluidly connected to different odor control agents.

Independent of the number and configuration of delivery devices 116, the one or more delivery devices may be positioned to introduce odor control agent 120 at a location that intermixes the odor control agent with a malodorous gas emitted at location 112. When introduced into the open atmosphere proximate location 112, natural air movement (e.g., wind) may have a tendency dissipate the discharged odor control agent. Accordingly, in some examples, delivery device 116 may introduce odor control agent 120 at a location comparatively close to location 112 where the malodorous gas may be emitted, such as at a location that is less than 25 meters from location (e.g., as measured from the discharge location of the delivery device to the closest perimeter edge of location 112), such as less than 10 meters, less than 5 meters, or less than 1 meter.

Odor control agent 120 may be a chemical composition containing one or more constituent components that can mask the smell of malodorous compounds present in the gas emissions and/or react with compounds in the gas emissions cause the malodorous smell. In some examples, odor control agent 120 is an aqueous composition that includes one or more surfactants, one or more essential oils, and optionally one or more molecules selected to react with one or more compounds in the gas emissions causing a malodorous smell.

Essential oils include natural oils typically obtained by distillation that have characteristic fragrance of the plant or other source from which it is extracted. Essential oils may be extracted from botanical sources and may be volatile oils. Non-limiting examples of essential oils that may be used in odor control agent 120 include cinnamon oil, cedar oil, clove oil, geranium oil, lemongrass oil, *Angelica* oil, mint oil, turmeric oil, wintergreen oil, rosemary oil, anise oil, cardamom oil, caraway oil, chamomile oil, coriander oil, guaiacwood oil, mint oil, parsley oil, basil oil, camphor oil, *Cananga* oil, citronella oil, *Eucalyptus* oil, ginger oil, copaiba balsam oil, *Perilla* oil, cedarwood oil, jasmine oil, palmarosa sofia oil, western mint oil, star anis oil, tuberose oil, neroli oil, tolu balsam oil, patchouli oil, palmarosa oil, *Chamaecyparis obtusa* oil, Hiba oil, sandalwood oil, petitgrain oil, bay oil, vetivert oil, bergamot oil, Peru balsam oil, bois de rose oil, grapefruit oil, lemon oil, mandarin oil, orange oil, oregano oil, lavender oil, *Lindera* oil, pine needle oil, pepper oil, rose oil, iris oil, sweet orange oil, tangerine oil, tea tree oil, tea seed oil, thyme oil, thymol oil, peppermint oil, linaloe oil, Japanese mint oil, spearmint oil, and combinations thereof.

Examples surfactants that may be used in odor control agent 120 include water soluble or water dispersible nonionic, semi-polar nonionic, anionic, cationic, amphoteric, and zwitterionic surfactants, and combination thereof. Anionic surfactants that may be used in the composition include linear and branched primary and secondary alkyl sulfates, alkyl ethoxysulfates, fatty oleyl glycerol sulfates, alkyl phenol ethylene oxide ether sulfates, the C5-C17 acyl-N—(C1-C4 alkyl) and —N—(C1-C2 hydroxyalkyl) glucamine sulfates, and sulfates of alkylpolysaccharides such as the sulfates of alkylpolyglucoside. In some examples, the anionic surfactant is a synthetic, water soluble anionic surfactant compound that includes the ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from about 5 to about 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives. Other anionic surfactants that may be used in the composition include olefin sulfonates, such as long chain alkene sulfonates, long chain hydroxyalkane sulfonates or mixtures of alkenesulfonates and hydroxyalkane-sulfonates.

In one example, the composition includes an anionic surfactant where the anionic group of the surfactant includes one of a sulfate, sulfonate, and benzene sulfonate, phosphate, carboxylate, and sulfosuccinate. For example, the anionic surfactant may include an anionic group that is a sulfate (e.g., a salt of a sulfate ester of a linear aliphatic alcohol). Example cations for the anionic surfactant may include one of potassium, ammonium, substituted ammonium salts, sodium, and magnesium. Representative anionic surfactants include sodium dodeccylbenzene sulfonate, sodium lauryl sulfate, magnesium lauryl sulfate, and sodium and magnesium undecyl sulfate.

When an alkyl sulfate anionic surfactant is used, the alkyl may, in different examples, be linear, branched, or include both linear and branched components. In some examples, the polar group in the anionic surfactant may be attached to the terminal carbon atom (1-position) and the alkyl group extending from the terminal position be 8 to 20 carbon atoms in length, such as 10 to 18 carbon atoms in length, or 11 to 16 carbon atoms in length. For example, the alkyl group in the surfactant may be a straight chain alkyl group, substituted in the 1-position, that contains twelve carbon atoms (i.e., the lauryl group). A variety of additional or different surfactants may be used.

Odor control agent 120 may be formulated with a majority weight percent water. For example, odor control agent 120 may be greater than 60 wt % water, such as greater than 70 wt % water, or greater than 80 wt % water. In some examples, odor control agent 120 may comprise from 75 wt % to 95 wt % water, such as from 80 wt % to 90 wt % water. The concentration of the surfactants present in odor control agent 120 may be within a range from 5 wt % to 25 wt %, such as from 10 wt % to 20 wt %. When essential oils are present in odor control agent 120, the concentration of the essential oils may be less than 10 wt % based on the total weight of the composition, such as less than 5 wt %, less than 4 wt %, or less than 3 wt %. For example, the concentration of the essential oils may be within a range from 1 wt % to 5 wt %, such as from 2 wt % to 4 wt %.

In some examples, odor control agent 120 may additionally or alternatively include one or more molecules selected to react with one or more compounds in the gas emissions causing a malodorous smell. For example, the one or more molecules can be selected to react with mercaptans, sulfides (e.g., dimethylsulfide dimethyldisulfide, hydrogen sulfide), nitrogen-based compounds (e.g., ammonia), and/or other target compounds known to cause a malodorous smell in the gas emission. When used, the reactive molecules can be present in odor control agent 120 at various concentration levels, which may or may not be within the ranges discussed above as being suitable for the essential oils component.

System 110 in the example of FIG. 2 also includes controller 118. Controller 118 can be communicatively connected to sensor 114, delivery device 116, and/or other controllable components of system 110 to manage the overall operation of the system. Controller 118 includes a processor 130 and a memory 132. Controller 118 can communicate with communicatively connected components via a wired or wireless connection. Controls signals sent from controller 118 and received by the controller can travel over the connection. Memory 132 stores software for running controller 118 and may also store data generated or received by processor 130, e.g., from sensor(s) 114. Processor 130 runs software stored in memory 132 to manage the operation of system 110.

Controller 118 may be implemented using one or more controllers, which may be located at the pulp mill site. Controller 118 may communicate with one or more remote computing devices 134 via a network 136. For example, controller 118 may communicate with a geographically distributed cloud computing network, which may perform any or all of the functions attributed to controller 118 in this disclosure.

Network 136 can be configured to couple one computing device to another computing device to enable the devices to communicate together. Network 136 may be enabled to employ any form of computer readable media for communicating information from one electronic device to another. Also, network 136 may include a wireless interface, and/or a wired interface, such as the Internet, in addition to local area networks (LANs), wide area networks (WANs), direct connections, such as through a universal serial bus (USB) port, other forms of computer-readable media, or any combination thereof. On an interconnected set of LANs, including those based on differing architectures and protocols, a router may act as a link between LANs, enabling messages to be sent from one to another. Communication links within LANs may include twisted wire pair or coaxial cable, while communication links between networks may utilize analog telephone lines, full or fractional dedicated digital lines, Integrated Services Digital Networks (ISDNs), Digital Subscriber Lines (DSLs), wireless links including cellular and satellite links, or other communications links. Furthermore, remote computers and other related electronic devices may be remotely connected to either LANs or WANs via a modem and temporary telephone link.

Controller 118 may receive data from sensor 114 in system 110 continuously or on a periodic basis. Data from sensor 114 can provide information indicative of a measured air characteristic associated with the pulp mill, which may be a characteristic associated with the pulp mill site generally (e.g., wind speed, wind direction) or may be a characteristic measured to a more localized region of the pulp mill site at or adjacent to location 112. Controller 118 can compare the measured air characteristic with reference information stored in memory 132. Further, controller 118 may tale various control actions, such as controlling delivery device 116 based on the measured air characteristic and/or comparison of the measured air characteristic with reference information.

FIG. 3 is a flow diagram illustrating an example technique that can be implemented by controller 118 and system 110 in FIG. 2 when sensor 114 is implemented using a wind sensor. The technique of FIG. 3 involves receiving, by controller 118, data from sensor 114 indicative of a characteristic of air associated with pulp mill 10 (FIG. 1) to provide a measured air characteristic (step 200). When sensor 114 is a wind sensor, the measured air characteristic may be one or both of wind speed and wind direction.

The example technique of FIG. 3 may further involve comparing, by controller 118, the measured air characteristic to one or more target air characteristics stored in memory 132 (step 202). The one or more target air characteristics may correspond to the measured air characteristic, such as wind speed and/or wind direction. For example, the one or more measured air characteristics may be one or more target wind speed (e.g., wind speed thresholds), with each threshold corresponding to a different wind speed. Additionally or alternatively, the one or more measured air characteristics may be one or more target wind directions (e.g., wind direction thresholds), with each threshold corresponding to a different direction.

For example, sensor 114 may be implemented to measure wind direction. One or more target wind directions may be stored in memory 132 associated with controller 118. The one or more target wind directions may correspond to a direction a human population is located proximate the pulp mill (schematically represented as a human population block 150 relative to location 112 on FIG. 2).

With reference to FIG. 3, controller 118 can control delivery device 116 to control delivery of odor control agent 120 based on comparison of the measured air characteristic to a target air characteristic (step 204). For example, when the measured air characteristic is wind speed and the target air characteristic is one or more wind speed thresholds, controller 118 may start or stop delivery device 116 or increase or decrease a delivery rate from delivery device 116 when the measured wind speed exceeds a wind speed threshold. The wind speed may indicate that the wind is sufficiently strong to blow the malodorous gas away from the pulp mill location 112, e.g., toward population 150. This can result in delivery of odor control agent 120. However, if the wind is strong enough to substantially entirely dissipate the malodorous gas, delivery of odor control agent 120 may be terminated.

As another example, when the measured air characteristic is wind direction, controller 118 may start or stop delivery device 116 or increase or decrease a delivery rate from delivery device 116 based on comparison of the measured wind direction to a target wind direction. For example, when the measured wind direction is determined by controller 118 to be blowing toward population 150, controller 118 may start delivery device 116 or increase a delivery rate from the delivery device of odor control agent 120. By contrast, if the measured wind direction is determined by controller 118 to be blowing away from population 150 (e.g., toward a substantially unpopulated area), controller 118 may stop delivery device 116 or decrease a delivery rate from the delivery device of odor control agent 120.

As still another example, multiple delivery devices 116 may be arranged about the perimeter of location 112. When controller 118 determines based on measured wind direction information from sensor 114, the controller may start one or more delivery devices located upstream of location 112 (in the direction of wind travel) and/or stop one or more delivery devices located downstream of location 112 (in the direction of wind travel). As the direction of the wind changes, controller 118 can start and/or stop different delivery devices 116 so odor control agent 120 is delivered upstream of location 112 and passes over the location to intermix with malodorous gas emitted from the location.

FIG. 4 is a flow diagram illustrating an example technique that can be implemented by controller 118 and system 110 in FIG. 2 when sensor 114 is implemented using a gas sensor. The technique of FIG. 4 involves receiving, by controller 118, data from sensor 114 indicative of a characteristic of air associated with pulp mill 10 (FIG. 1) to provide a measured air characteristic (step 300). When sensor 114 is a gas sensor, the measured air characteristic may be a concentration of one or more compounds associated with a malodorous smell. For example, sensor 114 may measure a concentration of one or more sulfur-containing compounds (e.g., methyl mercaptan, dimethylsulfide, dimethyldisulfide, hydrogen sulfide) and/or one or more nitrogen-containing compounds (e.g., ammonia). Gas sensor 114 can be selected and configured to measure the concentration of the one or more compounds of interest as very low levels. In some implementations, for example, sensor 114 may measure the one or more compounds at a concentration level of 500 ppb or less, such as 250 ppb or less, 100 ppb or less, 75 ppb or less, 50 ppb or less, 40 ppb or less, 30 ppb or less, 20 ppb or less, or 10 ppb or less. In either case, controller 118 may receive data indicative of one or more measured concentrations.

The example technique of FIG. 4 can also involve comparing, by controller 118, the measured air characteristic to one or more target air characteristics stored in memory 132 (step 302). For example, memory 132 may store one or more target concentrations associated with each compound whose concentration is measured by sensor 114. Controller 118 may compare the measured concentration of a compound to a target or threshold concentration for the compound. The threshold may be a level above which the compound provides detectable malodor but below which the compound is not particularly malodorous or offensive to the typical human. In some examples, the threshold concentration level may be quite low, such as a concentration level of 250 ppb or less, such as 100 ppb or less, 75 ppb or less, 50 ppb or less, 40 ppb or less, 30 ppb or less, 20 ppb or less, or 10 ppb or less.

In FIG. 4, controller 118 can control delivery device 116 to control delivery of odor control agent 120 based on comparison of the measured air characteristic to a target air characteristic (step 304). For example, when the measured concentration of a compound of interest exceeds a target or threshold concentration, controller 118 may start delivery device 116 or increase a delivery rate from delivery device 116. By contrast, when the measured concentration of a compound of interest is below a target or threshold concentration, controller 118 may stop delivery device 116 or decrease a delivery rate from delivery device 116.

With further reference to FIG. 2, controller 118 may take a variety of additional control actions based on information from sensor 114. In some examples, controller 118 may control issuance of a user alert (e.g., visual, text and/or graphics) on a computer user interface providing control instructions, a recommended course of action, and/or information concerning measurements made by sensor 114. An operator may interact with equipment either manually or through a controller interface (e.g., computer) controlling the equipment to implement desired actions.

The techniques described in this disclosure may be implemented, at least in part, in hardware, software, firmware or any combination thereof. For example, various aspects of the described techniques may be implemented within one or more processors, including one or more microprocessors, digital signal processors (DSPs), application specific integrated circuits (ASICs), field programmable gate arrays (FPGAs), or any other equivalent integrated or discrete logic circuitry, as well as any combinations of such components. The term "processor" may generally refer to any of the foregoing logic circuitry, alone or in combination with other logic circuitry, or any other equivalent circuitry. A control unit comprising hardware may also perform one or more of the techniques of this disclosure.

Such hardware, software, and firmware may be implemented within the same device or within separate devices to support the various operations and functions described in this disclosure. In addition, any of the described units, modules or components may be implemented together or separately as discrete but interoperable logic devices. Depiction of different features as modules or units is intended to highlight different functional aspects and does not necessarily imply that such modules or units must be realized by separate hardware or software components. Rather, functionality associated with one or more modules or units may be performed by separate hardware or software components, or integrated within common or separate hardware or software components.

The techniques described in this disclosure may also be embodied or encoded in a computer-readable medium, such as a non-transitory computer-readable storage medium, containing instructions. Instructions embedded or encoded in a computer-readable storage medium may cause a programmable processor, or other processor, to perform the method, e.g., when the instructions are executed. Non-transitory computer readable storage media may include volatile and/or non-volatile memory forms including, e.g., random access memory (RAM), read only memory (ROM), programmable read only memory (PROM), erasable programmable read only memory (EPROM), electronically erasable programmable read only memory (EEPROM), flash memory, a hard disk, a CD-ROM, a floppy disk, a cassette, magnetic media, optical media, or other computer readable media.

Various examples have been described. These and other examples are within the scope of the following claims.

The invention claimed is:

1. A method for controlling odor emissions from a pulp mill comprising:

receiving data by a controller from a sensor indicative of a characteristic of air associated with a pulp mill proximate a human population to provide a measured air characteristic, wherein the sensor is a wind sensor and the characteristic of air associated with the pulp mill is a wind direction;

comparing by the controller the measured air characteristic to a target air characteristic, wherein the target air characteristic is a target wind direction, and the target wind direction is a direction of the human population proximate the pulp mill;

if received data from the sensor indicates the wind direction is blowing in the direction of the human population proximate the pulp mill, starting by the controller delivery of an odor control agent; and if the received data from the sensor indicates the wind direction is blowing in the away from the direction of the human population proximate the pulp mill, stopping by the controller delivery of the odor control agent.

2. The method of claim 1, wherein controlling delivery of the odor control agent comprises delivering the odor control agent at a location positioned to intermix the odor control agent with a malodorous gas emitted at the pulp mill.

3. The method of claim 2, wherein the malodorous gas is emitted at the pulp mill at one or more of a digester, a lime kiln, a causticizer, a recovery boiler, and a waste water treatment plant.

4. The method of claim 3, wherein delivering the odor control agent at the location positioned to intermix the odor control agent with the malodorous gas emitted at the pulp mill comprises delivering the odor control agent at the location that is less than 25 meters from a location where the malodorous gas is emitted.

5. The method of claim 1, wherein controlling delivery of the odor control agent comprises one or more of spraying, misting, vaporizing, and/or atomizing a liquid form of the odor control agent into air.

6. The method of claim 1, wherein the pulp mill is a Kraft pulp mill.

7. The method of claim 1, wherein the odor control agent comprises an essential oil selected to mask a malodorous smell.

8. The method of claim 1, wherein the odor control agent comprises one or more reactive compounds selected to react with one or more sulfur-based and/or nitrogen-based compounds emitted by the pulp mill.

9. A pulp mill odor control system comprising:

a sensor positioned to measure a characteristic of air associated with a pulp mill to provide a measured air characteristic, wherein the sensor is a wind sensor and the characteristic of air associated with the pulp mill is a wind direction;

a delivery device configured to be fluidly coupled to a source of an odor control agent and to deliver the odor control agent to a location where a malodorous gas is emitted at the pulp mill; and a controller communicatively coupled to the sensor and the delivery device and configured to:

receive data from the sensor indicative of the measured air characteristic;

compare the measured air characteristic to a target air characteristic, wherein the target air characteristic is a target wind direction, and the target wind direction is a direction of a human population proximate the pulp mill;

if received data from the sensor indicates the wind direction is blowing in the direction of the human population proximate the pulp mill, start the delivery device to deliver the odor control agent; and if the received data from the sensor indicates the wind direction is blowing the direction away from the human population proximate the pulp mill, stop delivery of the odor control agent.

* * * * *